United States Patent [19]

Rosenberg

[11] Patent Number: 4,519,317

[45] Date of Patent: May 28, 1985

[54] SUB-CALIBER PROJECTILE

[75] Inventor: Gideon Rosenberg, Kiryat Tivon, Israel

[73] Assignee: The State of Israel, Ministry of Defence, Rafael Development Authority, Tel-Aviv, Israel

[21] Appl. No.: 501,069

[22] Filed: May 31, 1983

[30] Foreign Application Priority Data

Jun. 1, 1982 [IL] Israel ..... 65929

[51] Int. Cl.[3] ..... F42B 13/16

[52] U.S. Cl. ..... 102/521; 102/532; 244/3.26

[58] Field of Search ..... 102/520–523, 102/532; 244/3.26

[56] References Cited

U.S. PATENT DOCUMENTS 2,045,833 6/1936 Childs ..... 102/532
2,752,850 7/1956 Warner et al. ..... 244/3.26
2,773,450 12/1956 Donner ..... 102/520
3,125,957 3/1964 Lipinski ..... 244/3.26
3,961,580 6/1976 Burnett, Jr. et al. ..... 102/520

*Primary Examiner*—Harold J. Tudor
*Attorney, Agent, or Firm*—Browdy and Neimark

[57] ABSTRACT

A sub-caliber projectile having a front end, a tail end and a cylindrical shaped mid-section of substantially uniform diameter, sabot means comprising an annular obturating disc member and an annular stabilizing member, first retaining means for releasably securing said members together, said sabot means being mounted on and displaceable along said mid-section between a first position wherein it abuts said front end and a second position adjacent said tail end, and second retaining means for retaining said stabilizing member adjacent said tail end, the arrangement being such that after firing of said projectile said sabot means is displaced from said first position to said second position with the release of said obturating disc member from said stabilizing member and with the retention of the latter on said tail end.

3 Claims, 4 Drawing Figures

SUB-CALIBER PROJECTILE

This invention relates to a sub-caliber projectile and is of particular applicability to so-called "arrow" or penetrator projectiles wherein there is a relatively high length to diameter ratio and wherein the central body section of the projectile is of substantially uniform diameter. As is well known sub-caliber projectiles are provided with detachable sabots which serve to locate centrally the sub-caliber projectile in a larger bored launching weapon and which, together with the projectile serve to absorb the propellant force so as to result in the effective projection of the projectile out of the launching weapon at high velocity. The construction of the sabot and its coupling to the projectile must be such that the sabot or its component parts are detached from the projectile once the latter has left the bore of the launching weapon. Where, as is generally the case, the projectile is provided with a radially enlarged stabilizing tail portion, the sabot can clearly not disengage itself from the projectile by passing over the tail portion and means are provided to ensure that the sabot components are displaced radially with respect to the projectile when the latter has left the launching weapon.

It is an object of the present invention to provide a new and improved sub-caliber projectile wherein the problems of coupling and detaching the sabot from the projectile are essentially reduced.

According to the present invention there is provided a sub-caliber projectile having a front end, a tail end and a cylindrically shaped mid-section of substantially uniform diameter, sabot means comprising an annular obturating disc member and an annular stabilizing member, first retaining means for releasably securing said members together, said sabot means being mounted on and displaceable along said mid-section between a first position wherein it abuts said front end and a second position adjacent said tail end, and second retaining means for retaining said stabilizing member adjacent said tail end, the arrangement being such that upon firing of said projectile, said sabot means is displaced from said first position to said second position with the release of said obturating disc member from said stabilizing member and with the retention of the latter on said tail end.

With such a sub-caliber projectile in accordance with the present invention the annular stabilizing member constitutes part of the sabot means and effectively supports the sabot obturating disc when the latter is disposed adjacent the front end of the projectile so as to take up the propellant force. However, after launching, the stabilizing member slides along the mid-section until it becomes located and retained in position adjacent the tail end so as to fulfill its stabilizing function during the flight of the projectile whilst at the same time the obturating disc becomes detached from the stabilizing portion passing over the tail end of the projectile.

The use of a component portion of the sabot means as stabilizing means for the projectile results in a substantial saving in weight and in this way there is achieved a substantially increased muzzle velocity. Furthermore the fact that the detached obturating disc becomes detached in a rearward direction rather than radially, gives rise to a much smoother detachment of the sabot, this having considerable beneficial effect on the stability of flight of the projectile.

Furthermore, in view of the fact that there is no rigid coupling between the sabot means and the projectile body whilst nevertheless maintaining an effective gas seal between them, any spin induced in the sabot means as a consequence of rifling of the weapon launcher bore is not transmitted to the projectile.

Furthermore, with this construction there is no need to provide locating grooves along the length of the projectile which is common with sub-caliber projectiles of a known kind and the absence of such locating grooves increases the penetrating power of the projectile.

Various embodiments of the present invention as applied to a sub-caliber penetrator type projectile will now be described by way of example and with reference to the accompanying drawings in which.

Figure 1:
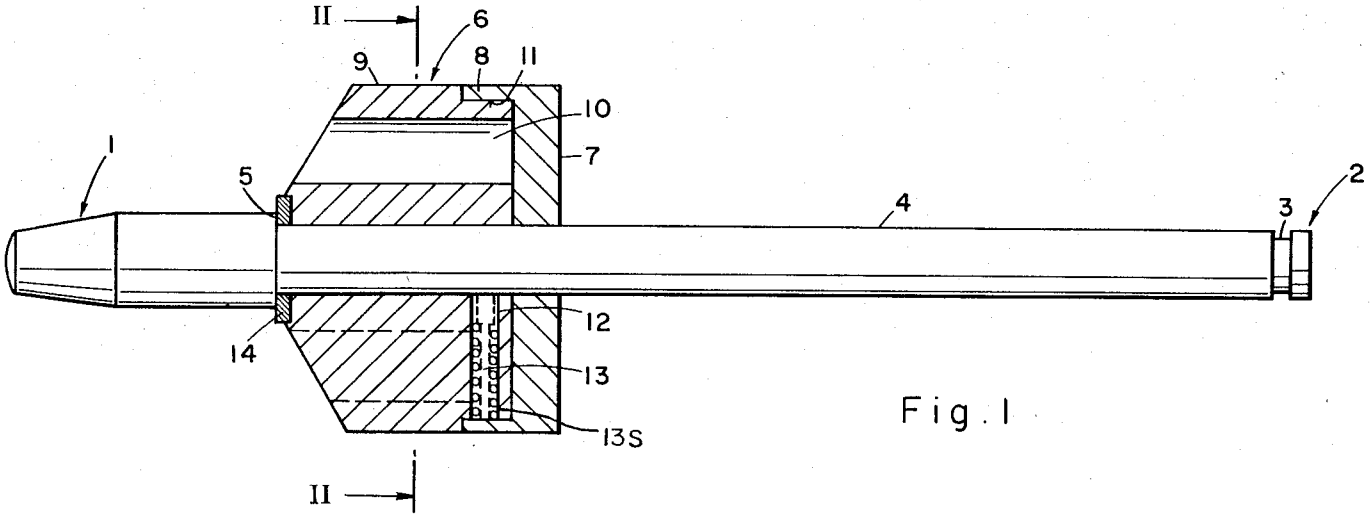
FIG. 1 is a side elevation of the projectile with its sabot means shown in section.
Figure 2:
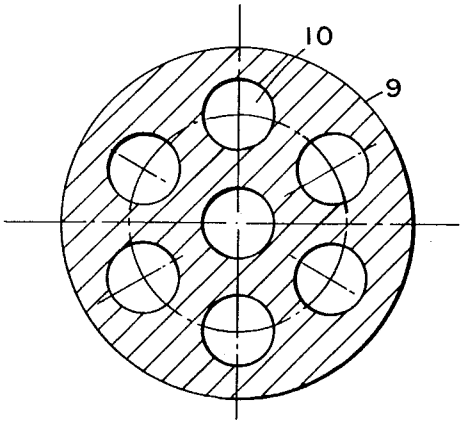
FIG. 2 is a cross-sectional view of the stabilizing portion taken along the line II—II of the view shown in FIG. 1.

As seen in FIGS. 1 through 4 of the drawings the sub-caliber projectile is of the penetrator kind where its length to diameter ratio is significantly high. The projectile is formed with an ogival front end 1, a tail end 2 formed with an annular peripheral recess 3 and a cylindrically shaped mid-section 4 of substantially uniform diameter. The latter merges with the ogival front end 1 via an annular, abutment shoulder 5.

The projectile is provided with sabot means 6, comprising an annular obturating disc 7 having a peripheral skirt 8 and a substantially cylindrical stabilizing member 9. The latter is formed with a plurality of throughgoing axially directed bores 10 and with a peripheral recess 11 into which is designed to fit the skirt 8. There is furthermore formed in the member 9 a radially directed bore 12 in which is located a retaining pin 13 loaded by a spring 13*s*. One end of the pin 13 is, as shown in FIG. 1 of the drawings spring biased into a locating bore formed in the skirt 8 and the other end bears against the mid-section 4.

The forward end of the stabilizing member is tapered and is provided at its central planar end portion with a bearing disc 14.

Figure 3:
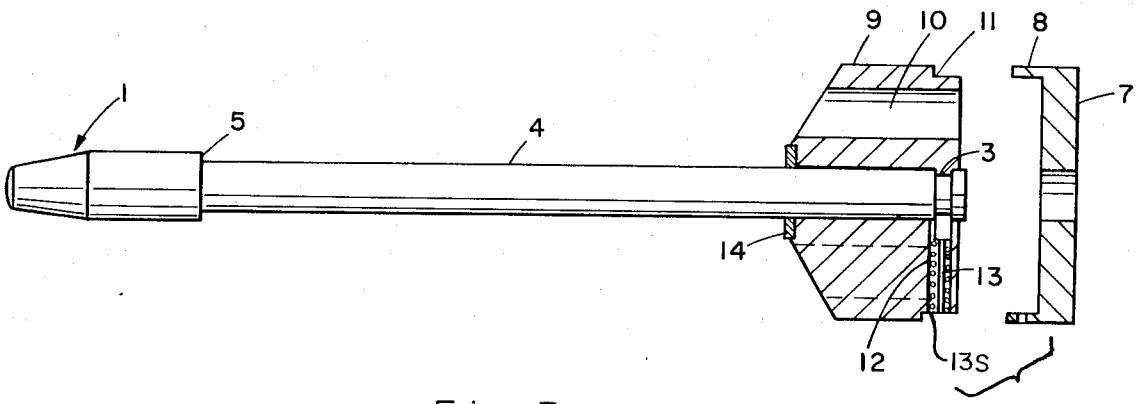
FIG. 3 shows the projectile with its stabilizing portion positioned at its tail and with the sabot obturating disc shown detached.

The sabot means 6 is clearly slidable along the mid-section 4 from a first position, wherein the bearing disc 14 bears against the abutment shoulder 5, to a second position wherein the innermost end of the spring loaded pin 13 enters the recess 3 thereby allowing for the detachment of the obturating disc 7 (as seen in FIG. 3 of the drawings). The sabot means 6 is also rotationally displaceable with respect to the mid-section 4.

In use with the projectile located in the bore of the launching weapon, the obturating disc 7 supported and located by the stabilizing member 9 effectively seals the bore and, upon firing, takes up the propulsion forces and as a consequence the projectile is launched with substantial initial velocity. After launching the sabot means is displaced rearwardly along the cylindrical section 4 until the retaining pin 13 enters the recess 3 by being biased thereinto by spring 13*s*, whereupon the obturating disc is detached and is displaced rearwardly away from the projectile. The stabilizing portion 9 is retained in position at the tail end of the projectile and now performs a conventional function as a stabilizing tail.

Figure 4:
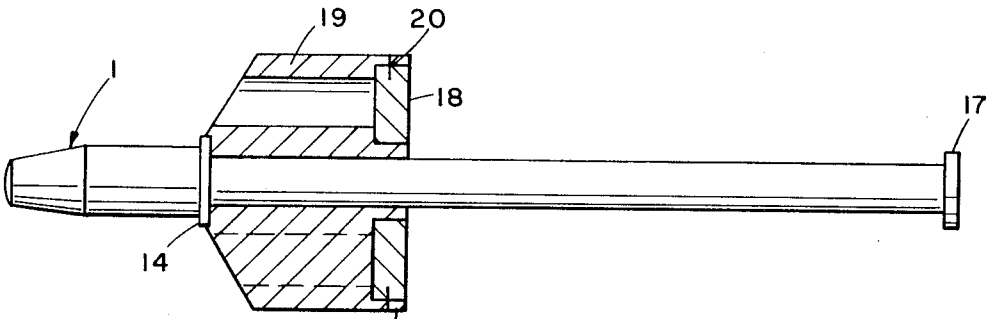
FIG. 4 is a side elevation of a sub-caliber projectile having a modified form of sabot means.

In an alternative embodiment of a sabot means, as shown in FIG. 4 of the drawings, the tail end of the projectile is formed with an outwardly directed flange 17 whilst an annular obturating disc 18 is formed with its central aperture of greater diameter than that of the flange 17 and is located in an annular end recess formed in a stabilizing member 19 otherwise of similar construction to the stabilizing member shown in FIG. 1 of the drawings. In this case, however, the obturating disc 18 is secured to the stabilizing member 19 by means of shearable retaining pins 20. In the case of this embodiment, upon the rearward displacement of the sabot means after firing towards the flange 17 and upon abutment of this flange by means of the stabilizing member 19, the momentum acquired by the obturating disc 18 together with the stagnation air pressure on the disc, are such as to result in the shearing of the retaining pins 20 and the consequent detachment of the disc 18 from the stabilizing member 19 which is retained in position against the flange 17.

It can thus be seen that the incorporation of the stabilizing member in the sabot means and the retention thereof after firing in the correct position on the tail results in a considerable saving of weight. Furthermore, the fact that the detached obturating disc of the sabot means separates from the projectile in a rearward direction minimizes disturbance of the flight of the projectile as a result of the separation. Finally, the fact that the sabot means is rotationally displaceable with respect to the projectile ensures that any spin imparted to the sabot means is not necessarily transmitted to the projectile.

Whilst the invention has been specifically described with respect to a stabilizing portion of substantially cylindrical shape, it is equally applicable when the stabilizing portion has other forms such as, for example, is formed with radially directed stabilizing fans.

I claim:

1. A sub-caliber projectile having a front end, a cylindrically shaped mid-section of substantially uniform diameter and having a substantially smooth surface and a tail end, at least the portion of the front end adjacent to said mid-section being of increased diameter with respect to the diameter of said mid-section so as to define an abutment shoulder adjacent said front end, sabot means comprising an annular stabilizing member and an annular obturating disc member, first retaining means for releasably securing said members together, said sabot means being mounted on and axially displacable as a unit along said mid-section between a first position wherein said stabilizing member abuts said abutment shoulder and a second position adjacent said tail end wherein said stabilizing member is retained and said obturating disc is axially detached therefrom, and second retaining means for retaining said stabilizing member adjacent said tail end.

2. A projectile according to claim 1 or 2 wherein said first retaining means is constituted by shearable pins retaining said members together and wherein said second retaining means is constituted by a peripheral flange formed on said tail end against which said stabilizing member retainably abuts when in said second position.

3. A projectile according to claim 1 wherein at the mid-section, adjacent the tail end, the projectile defines a peripheral recess and said first and second retaining means include a pin having first and second ends, located in a radial cavity in said stabilizing member and a spring about said pin whereby when said sabot means is in said first position said spring biases the pin's first end against the projectile mid-section and the pin's second end engages said disc member, thereby coupling said two members to one another, and when said sabot means is at said second position said spring advances the pin's first end into said peripheral recess to thereby retain said stabilizing member at said second position, and as a result of the advancement of the pin's first end into said recess the pin's second end is disengaged from said disc member.

* * * * *

UNITED STATES PATENT AND TRADEMARK OFFICE

CERTIFICATE OF CORRECTION

PATENT NO. : 4,519,317

DATED : May 28, 1985

INVENTOR(S) : Gideon ROSENBERG

It is certified that error appears in the above-identified patent and that said Letters Patent is hereby corrected as shown below:

[73] Assignee: The State of Israel, Ministry of Defence, Rafael Armament Development Authority, Tel-Aviv, Israel Claim 2, line 1: delete "or 2".

Signed and Sealed this

*Seventh* Day of *January 1986*

[SEAL]

*Attest:*

DONALD J. QUIGG

*Attesting Officer*

*Commissioner of Patents and Trademarks*